United States Patent [19]

Sbaschnigg

[11] Patent Number: 4,681,659

[45] Date of Patent: Jul. 21, 1987

[54] MULTI-NIP HIGH PRESSURE PRESS

[75] Inventor: Johann Sbaschnigg, Graz, Austria

[73] Assignee: Maschinenfabrik Andritz Actiengesellschaft, Graz, Austria

[21] Appl. No.: 784,167

[22] Filed: Oct. 4, 1985

Related U.S. Application Data

[63] Continuation-in-part of Ser. No. 541,300, Oct. 12, 1983, abandoned.

[30] Foreign Application Priority Data

Oct. 12, 1982 [AT] Austria ..... 3756/82

[51] Int. Cl.[4] ..... B30B 9/24; D21F 3/02; F26B 13/28

[52] U.S. Cl. ..... 162/360.1; 100/118; 100/154; 162/358

[58] Field of Search ..... 162/358, 360.1; 210/400, 305, 401; 100/118, 119, 120, 153, 154

[56] References Cited

U.S. PATENT DOCUMENTS

| | | | |
|---|---|---|---|
| 3,600,273 | 8/1971 | McCarrick et al. | 162/358 |
| 3,796,148 | 3/1974 | Heissenberger | 162/358 |
| 3,796,149 | 3/1974 | Heissenberger | 162/358 |

FOREIGN PATENT DOCUMENTS

| | | | |
|---|---|---|---|
| 3335177 | 4/1984 | Fed. Rep. of Germany . | |
| 28145 | 7/1984 | Fed. Rep. of Germany | 162/360 |
| 2534358 | 4/1984 | France . | |
| 592904 | 2/1978 | U.S.S.R. | 162/301 |

*Primary Examiner*—S. Leon Bashore
*Assistant Examiner*—K. M. Hastings
*Attorney, Agent, or Firm*—Frost & Jacobs

[57] ABSTRACT

A multi-nip high pressure press is disclosed, which can be connected to double, longitudinal or circular strainer machines but where this press is a single machine, using an additional pressing segment including at least one pair of rollers of lesser diameters mounted in advance of a pair of compression rollers.

2 Claims, 1 Drawing Figure

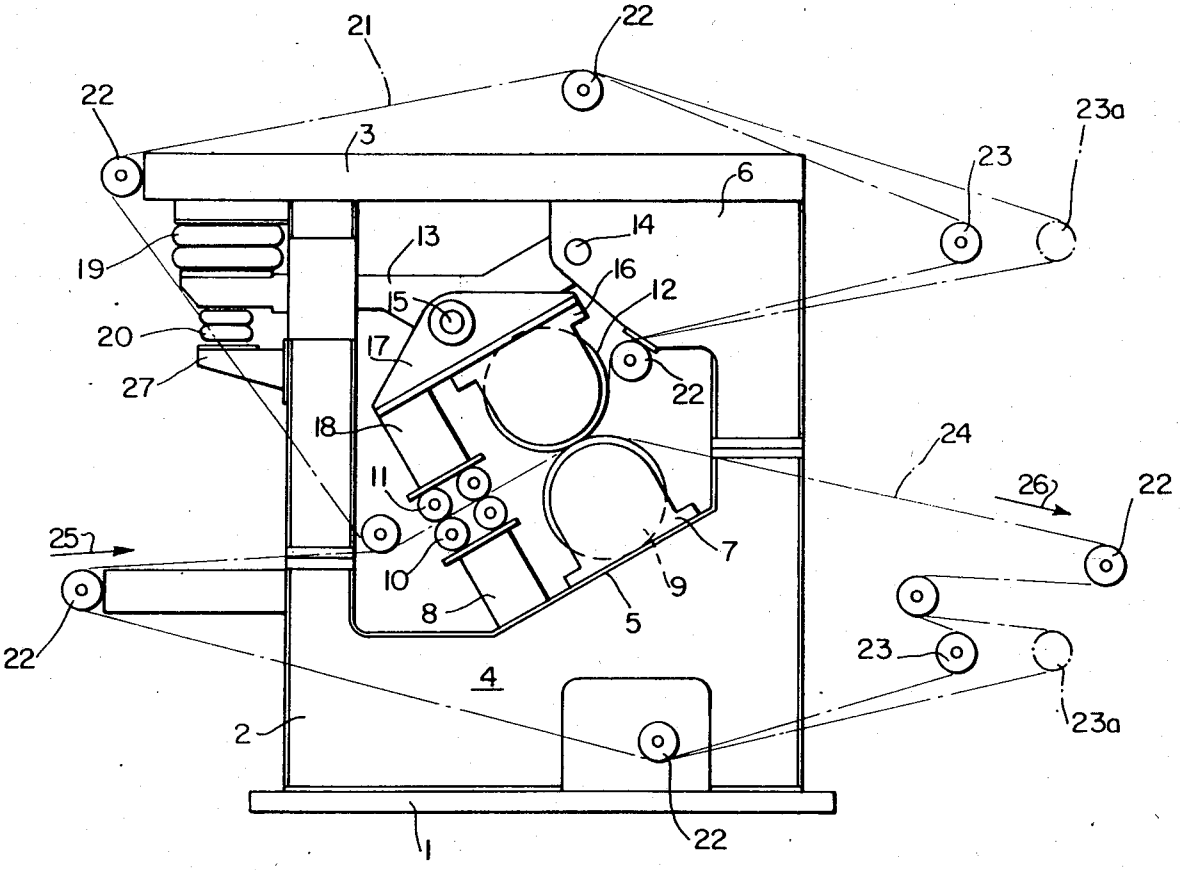
1
2
3
4
5
6
7
8
9
10
11
12
13
14
15
16
17
18
19
20
21
22
23
23a
24
25
26
27

MULTI-NIP HIGH PRESSURE PRESS

RELATED APPLICATION

This application is a continuation-in-part of copending U.S. application Ser. No. 541,300, filed Oct. 12, 1983 now abandoned.

BACKGROUND OF THE INVENTION

The invention relates to a multi-nip high pressure press for further dehydration of lengths of materials or the like, connected to a dehydrating machine such as that disclosed in U.S. Pat. No. 3,796,148, or to a double, longitudinal or circular strainer machine, and being composed of a pair of compression rollers mounted in a frame of their own, with an upper straining and/or filter belt of the upper compression roller and an identical lower strainer and/or filter belt of the lower compression roller being made to pass in common with the compressed material from the dehydrating machine through the compression nip of the pair of compression rollers.

The object of this multi-nip high pressure press is to increase the dehydration effect and to enhance the efficiency of the equipment.

It is known to connect high pressure presses to double strainer belt dehydrating machines, and also to longitudinal and circular strainer equipment, where the high pressure presses consist as a rule of one pair of compression rollers. This pair of compression rollers receives the web of material and once more forces out the residual moisture therein. The compression rollers are supported one above the other, whereby the length of material can be made to pass through horizontally. In special cases even several such presses are serially connected behind the dehydration machines. Such presses are assembled in the form of rollers supported in their own frame and provided with adjustment means to vary the roller compression. The dehydration is carried out using endless felt or strainer belts which pass through the roller gap together with the material being compressed.

These additional press assemblies have the drawback that one press alone is inadequate to substantially increase the dehydration effect. The resultant constrained use of several such presses does on one hand offer the advantage of dehydration, but on the other hand, the cost of construction is appreciable. Bulk is large and energy consumption also is higher.

SUMMARY OF THE INVENTION

Based on this state of the art, it is the object of the present invention to provide a multi-nip high pressure press which can be connected to double, longitudinal or circular strainer machines, but which comprises a single machine and furthermore achieves a greater dehydration effect. This goal is attained by the invention in that one or more pairs of press rollers of lesser diameter precede the pair of compression rollers. This special design of the roller arrangement results in a compact, high-output machine.

According to the invention there is provided a high pressure press for the further dehydration of material in the form of a web supplied from a dehydration machine to which said press is connected, said press being composed of a pair of compression rollers comprising a lower roller and an upper roller each mounted in its own frame and with an upper strainer and/or felt belt of the upper roller and a lower strainer and/or felt belt of the lower roller, both strainers and/or felt belts passing jointly with material to be pressed through the compression nip of said pair of compression rollers, at least one pair of press rollers immediately preceding said pair of compression rollers, and an ascending, guided belt track between said pair of rollers and said compression rollers whereby to obtain effective discharge of water.

For optimal drainage, the invention provides in a particularly important further development of the device that each roller of said at least one pair of rollers has a diameter of about one-fourth the diameter of said compression rollers. This is of particular advantage with an ascendingly guided belt track.

The invention is further discussed below in relation to an illustrative embodiment.

BRIEF DESCRIPTION OF THE DRAWING

The FIGURE of drawing shows a multi-nip high pressure press in elevation.

DETAILED DESCRIPTION

The multi-nip high pressure press shown in the FIGURE is composed of the base plate 1 to which are mounted two side parts as the frame 2 each of which is terminated at the top with an upper cross beam 3. The frame 2 is of such a design that a connecting plate 4 with a sloping rest surface 5 remains above the base plate 1. A sector plate 6 extending to the middle of the frame is present adjacent the upper cross-beam 3. The two bearing blocks 7 and 8 rest on the rest surface 5, the bearing block 7 supporting the lower roller 9 and the bearing block 8 the preceding rollers 10 of lesser diameter. A pivot bearing 14 is provided at the center of the frame 2, that is in the sector plate 6. A lever 13 receiving a beam 17 is hinged on the bearing 14. The beam 17 is movably supported by means of the pivot bearing 15. Below the beam 17 are suspended the bearing blocks 16, 18 receiving the upper roller 12 and the smaller roller 11 respectively. To adjust the lever 13 in a simple manner, it is provided with an extension reaching so far that a pressure bellows 19 can act on the outer end thereof. This pressure bellows is mounted on the extension of the upper cross beam 3. Another pressure bellows 20 lifts the rollers 11, 12 and rest on a bracket 27 at the frame 2 on the opposite side of the lever 13. The two pressure bellows 19,20 are mounted plumb one below the other and are made operational as needed to lift the rollers or to apply pressure.

An upper strainer belt 21 is guided by the reversing rollers 22 end the tensioning roller 23 and passes between the pairs of rollers 9, 12 and 10, 11 and around the upper roller 12. Again a lower strainer belt 24 is provided for the lower rollers 9, 10 which also passes around the associated reversing rollers 22 and the tensioning roller 23. The drawing further indicates by dash-dot lines one tensioning roller 23*a* each, illustrating how far the tensioning means can be advanced. Arrow 25 shows where the material to be compressed is fed into the machine and arrow 26 where this material is discharged. It is essential that for known compression rollers such as the lower roller 9 and the upper roller 12, there be an additional pair of compression rollers with rollers 10, 11 of lesser diameter directly before the input to the rollers 9 and 12. Preferably a double pair of rollers is provided as in the illustrative embodiment. It is essential in this regard that the diameters of the smaller rollers 10, 11 be about one fourth the diameter of the compression rollers 9, 12 and that the length of material is guided to be ascending. The brackets 7, 8 are designed in such a manner that both rollers 9, 10 are at about the same elevation from the rest means 5 whereby the length of material is guided approximately parallel to the rest means 5. Because the rest means 5 is mounted at an angle in the machine, the length of material accordingly will be ascending, and effective discharge of water from the press nips is obtained, without use of suction rolls.

This special design achieves a substantial improvement in the dehydration effectiveness because the preceding smaller roller can apply a pressure on the length of material sufficiently high that a high solids content of 50 to 55% then can be obtained in combination with the compression rollers when the web supplied from the dehydration machine has a solids content of about 35 to 40%. This drying rate hitherto has been achieved only by mounting several machines with single presses. In the configuration of the invention using the special roller arrangement, the same degree of dehydration requires only a single machine.

The ratio of the diameters of press rollers 10, 11 relative to the diameters of compression rollers 9, 12 as defined above has been found by actual tests to provide optimum dehydration at minimum compression force with consequent gentle treatment of the web of material.

In order to avoid overlapping of the web of material as it is lengthened due to the compression thereof, the distance between the pair of press rollers 10, 11 closest to the compression rollers 9, 12 is preferably less than half the diameter of compression rollers 9 and 12. Tensioning of the length of material also assists in this repect.

It will be obvious to those skilled in the art that many modifications may be made within the scope of the present invention without departing from the spirit thereof, and the invention includes all such modifications.

I claim:

1. A device for further dehydration of lengths of material and adapted to be attached as a separate unit to a dehydrating machine such as a double, longitudinal or circular strainer, said device comprising a pair of compression rollers mounted in their own frame through the compression nip of which an individual lower strainer and/or felt belt is caused to pass together with a length of material discharged from said dehydrating machine, said lower strainer and/or felt belt being separate from said dehydrating machine and abutting the lower one of said pair of compression rollers, each of said compression rollers having substantially the same diameter, at least one pair of rollers immediately preceding said pair of compression rollers, each roller of said at least one pair of rollers having a diameter of about one-fourth the diameter of each of said compression rollers, an upper strainer and/or felt belt separate from said dehydrating machine and abutting the upper one of said pair of compression rollers, wherein said lower strainer and/or felt belt and said upper strainer and/or felt belt are guided ascendingly within the area of said pair of compression rollers and said at least one pair of rollers of lesser diameter with said length of material compressed therebetween, and wherein bearings for said upper compression roller and for the upper one of each of said at least one pair of rollers of lesser diameter are attached to a common, movable supported beam on which a lever pivoted to said frame is articulated.

2. The device claimed in claim 1, wherein two pressure bellows attached to said frame act on said lever for alternatively lifting said rollers and applying pressure thereto, and wherein a bearing for said beam on said lever is provided above said compression rollers.

* * * * *